United States Patent [19]

Lemburg

[11] 4,281,690

[45] Aug. 4, 1981

[54] METHOD AND APPARATUS FOR MAKING WIRE BINDERS FOR PADS OR THE LIKE

[75] Inventor: Jörn-Uwe Lemburg, Richmond, Va.

[73] Assignee: E. C. H. Will (GmbH & Co.), Hamburg, Fed. Rep. of Germany

[21] Appl. No.: 91,411

[22] Filed: Nov. 5, 1979

[30] Foreign Application Priority Data

Nov. 3, 1978 [DE] Fed. Rep. of Germany ..... 2847700

[51] Int. Cl.[3] ..... B21F 45/00

[52] U.S. Cl. ..... 140/71 R; 11/1 A; 72/187; 140/105

[58] Field of Search ..... 140/71 R, 105; 72/187, 72/196; 11/1 A

[56] References Cited

U.S. PATENT DOCUMENTS

| | | | |
|---|---|---|---|
| 2,130,318 | 9/1938 | Cruzan | 140/71 R |
| 2,832,392 | 4/1958 | Spitz | 140/71 R X |
| 3,566,927 | 3/1971 | Adams | 140/71 R |
| 4,047,544 | 9/1977 | Seaborn et al. | 140/105 |

FOREIGN PATENT DOCUMENTS

| | | | |
|---|---|---|---|
| 919345 | 10/1954 | Fed. Rep. of Germany | 140/71 R |

*Primary Examiner*—Gil Weidenfeld
*Assistant Examiner*—K. J. Ramsey
*Attorney, Agent, or Firm*—Peter K. Kontler

[57] ABSTRACT

A web of undulate wire is converted into a series of coherent C-shaped binders of the type known by the trademark Wire-O and used to bind stacks of paper sheets or the like in the making of steno pads, brochures, calendars and similar stationery products by continuously moving the web lengthwise at a constant or variable speed, by imparting to successive increments of one marginal portion of the moving web a concavo-convex shape in stepwise fashion so that the one marginal portion resembles (in cross-section) one-half of the letter C, and by thereupon imparting to successive increments of the other marginal portion of the moving web a concavo-convex shape in stepwise fashion so that the thus converted other marginal portion becomes a mirror image of the converted one marginal portion. The imparting steps include deforming the respective marginal portions from the inner toward the outer edges thereof.

20 Claims, 19 Drawing Figures

METHOD AND APPARATUS FOR MAKING WIRE BINDERS FOR PADS OR THE LIKE

BACKGROUND OF THE INVENTION

The present invention relates to a method and apparatus for making wire binders for steno pads, calendars, brochures and like commodities wherein a stack of sheets is held together along one edge so that the sheets can be flipped about an axis which is defined by the properly inserted binder. More particularly, the invention relates to improvements in a method and apparatus for converting a length of wire into an undulate web and for thereupon converting the undulate web into a substantially C-shaped body which is ready to be subdivided into discrete binders.

It is already known to convert a straight metallic or plastic wire, which is withdrawn from a barrel, reel or another suitable source of supply, into a meandering or undulate web whose loops are located in or can be moved into a common plane. Such web is thereupon bent along an axis which extends lengthwise of the web to achieve the conversion into a C-shaped or trough-shaped structure having prongs along one or both marginal portions so that it can be introduced into the registering perforations of stacked sheets preparatory to conversion of individual C-shaped constituents into rings. The conversion of straight wire into an undulate or meandering web can be carried out in a machine of the type disclosed in the commonly owned U.S. Pat. No. 4,165,767 granted Aug. 28, 1979 to Seaborn and Lemburg. The web is converted into a C-shaped structure by resorting to several deforming tools, e.g., two pressing tools, and to a conveyor system which advances the undulate web through the deforming station in stepwise fashion. During each interval between successive stepwise advances of the undulate web, the marginal portions of such web are treated by one of the deforming tools and the median portion or the regions bounding the median portion of the web are thereupon treated by another deforming tool. Reference may be had to U.S. Pat. No. 4,047,544 granted Sept. 13, 1977 to Paul Seaborn et al. A drawback of such intermittently operated apparatus is that their output is relatively low. Therefore, apparatus of the type disclosed in U.S. Pat. No. 4,047,544 are not directly coupled to machines which can turn out undulate web of metallic or plastic wire at a relatively high rate of speed. In other words, the patented apparatus cannot be used as a constituent of a complete production line which converts wire into binders, which assembles or otherwise treats stacks of sheets, and which inserts binders into discrete stacks. Certain stacks can be held together by a single binder, and certain other stacks are held together by two or more converted C-shaped or trough-shaped binders.

OBJECTS AND SUMMARY OF THE INVENTION

An object of the invention is to provide a novel and improved method of treating wire preparatory to conversion into discrete sections of binders for stacks of paper sheets or the like.

Another object of the invention is to provide a method which can be resorted to for the production of a large number of wire binders per unit of time.

A further object of the invention is to provide a method which renders it possible to move the wire continuously during conversion into a C-shaped or trough-shaped body.

An additional object of the invention is to provide a novel and improved apparatus for the practice of the above outlined method.

Another object of the invention is to provide an apparatus which can be resorted to for conversion of straight metallic or plastic wire into a C-shaped or trough-shaped web in a small area, while the material is in a continuous motion, and with a high degree of reproducibility.

A further object of the invention is to provide the apparatus with novel and improved means for converting a web of undulate wire into a C-shaped body which can be subdivided into binders of desired length.

One feature of the invention resides in the provision of a method of converting an elongated web of undulate metallic or plastic wire which includes a pair of longitudinally extending marginal portions into a series of interconnected substantially C-shaped binders which can be used to connect the sheets of a stack of paper sheets or the like. The method comprises the steps of moving the web lengthwise (such step preferably includes continuously conveying the web lengthwise along a predetermined path), gradually imparting to successive increments of one marginal portion of the web a concavo-convex configuration which, in cross-section, resembles or matches substantially one-half of the letter C, and gradually imparting to successive increments of the other marginal portion of the web a concavo-convex configuration which is a mirror image of the concavo-convex configuration of the one marginal portion.

One of the imparting steps preferably follows the other imparting step, and each imparting step preferably includes deforming the web (e.g., by rolling) in a direction toward the outer edge of the respective marginal portion. At least one imparting step preferably comprises deforming the respective marginal portion in a plurality of discrete stages. In accordance with a presently preferred embodiment of the method, each of the imparting steps includes deforming successive increments of the respective marginal portion in stepwise fashion (e.g., between the peripheral surface of a rotating disc-shaped anvil and the peripheral surfaces of several successive rolls which are driven to rotate about their respective axes and whose axes make different angles with the axis of the anvil).

The method preferably further comprises the step of tensioning successive increments of the web in the longitudinal direction of the wire prior to at least one of the imparting steps. This can be carried out by resorting to a stretching wheel which advances successive increments of the web toward the periphery of the respective disc-shaped anvil.

It is also within the purview of the invention to utilize a web whose central portion remains flat so that the ultimate product resembles, in cross-section, an elongated capital letter C.

The web which is converted into a body having a cross-sectional outline resembling the letter C is ready to be severed to yield discrete binders of desired length which can be introduced into the perforations of a stack of paper sheets or the like prior to undergoing further deformation which results in conversion of the loops of each binder into rings. Finished binders of the type to which the present invention pertains are sold under the registered trademark Wire-O.

The novel features which are considered as characteristic of the invention are set forth in particular in the appended claims. The improved apparatus itself, however, both as to its construction as well as its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
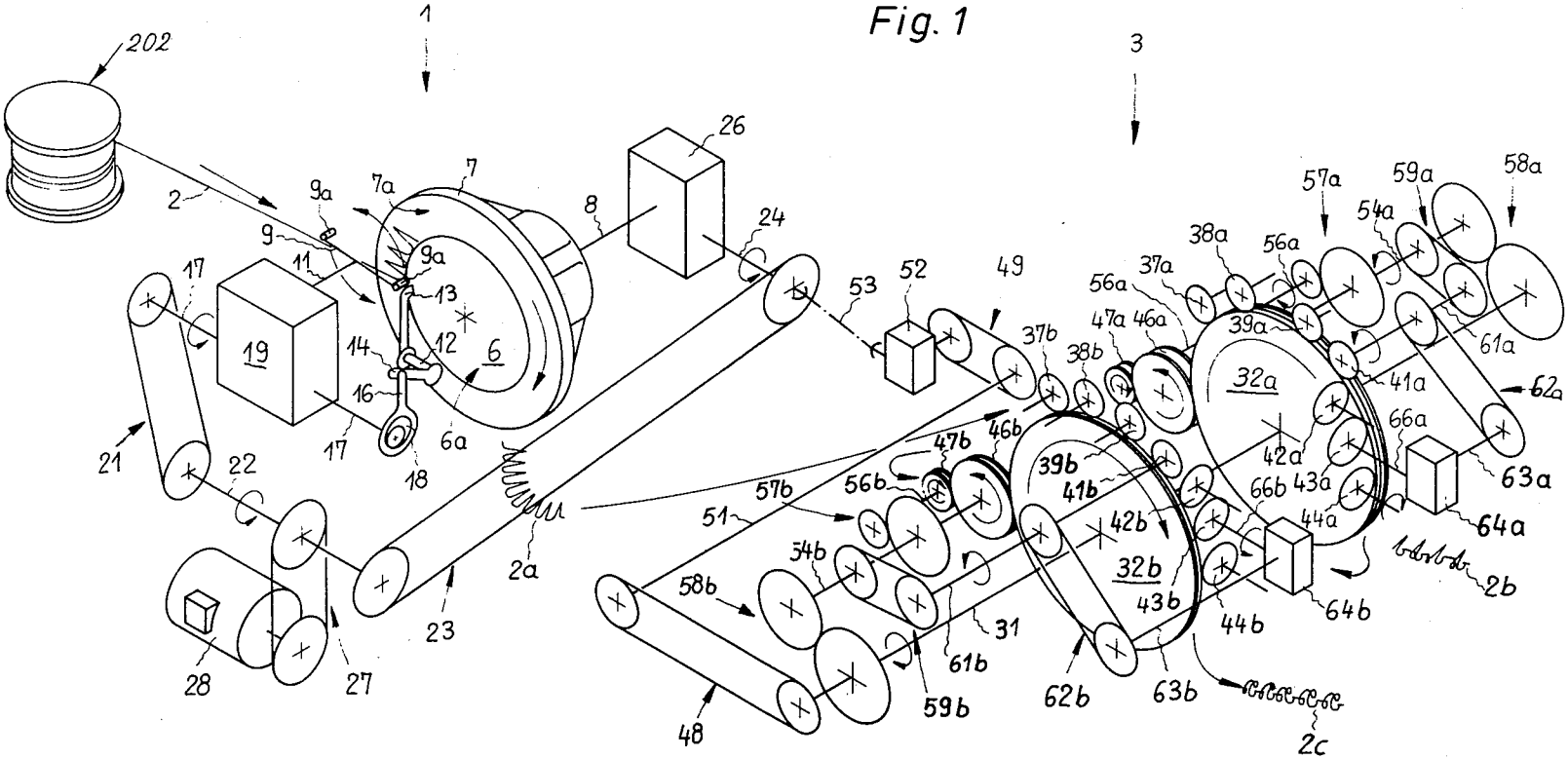
FIG. 1 is an exploded schematic perspective view of an apparatus which embodies the invention.
Figure 2:
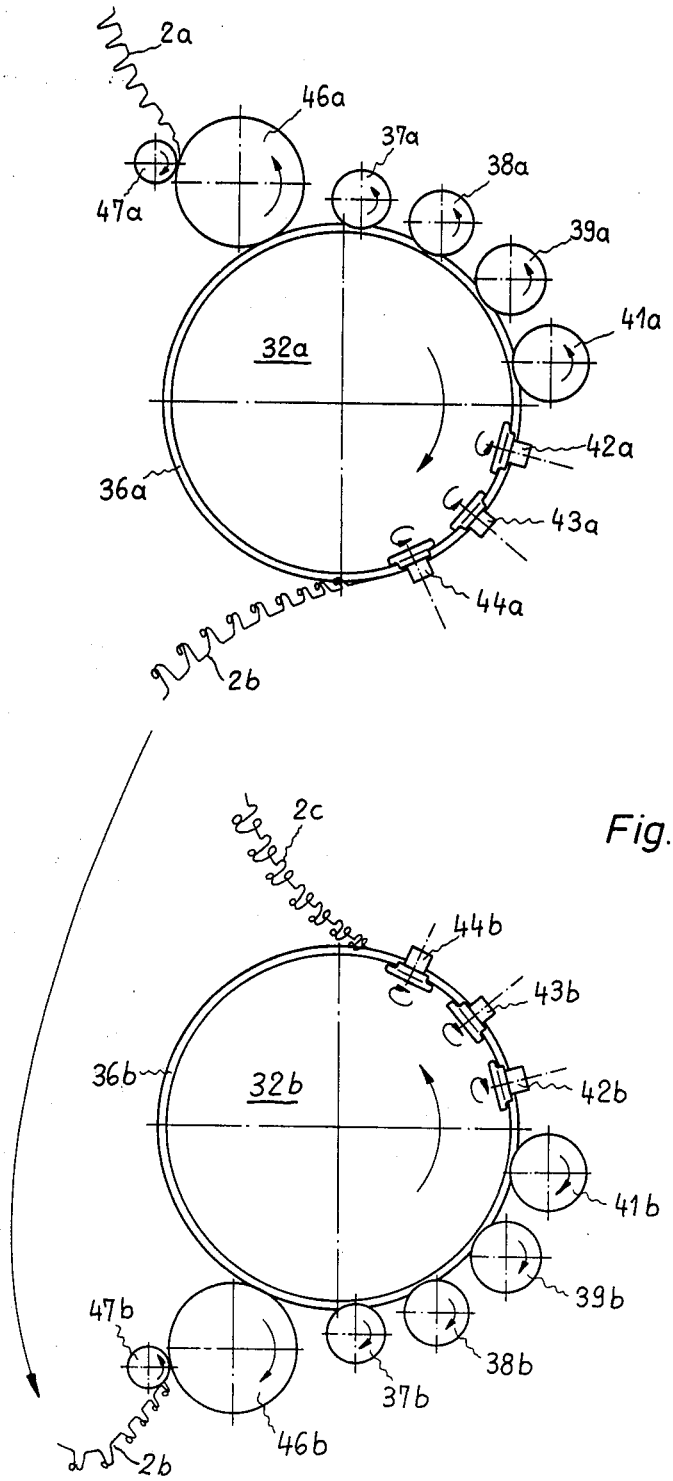
FIG. 2 is an enlarged front elevational view of the conveying, stretching and deforming means in the apparatus of FIG. 1.

The apparatus of FIG. 1 comprises a first or primary deforming unit 1 which continuously converts a continuous strand of plastic or metallic wire 2 (such strand can be drawn off a reel in a barrel 102 or another suitable source) into an undulate flat web 2*a*. The undulations or loops of the web 2*a* are or can be located in a common plane, i.e., the wire 2 is converted into a relatively narrow web with portions of wire 2 extending substantially at right angles to the longitudinal direction of the web.

Figure 3:
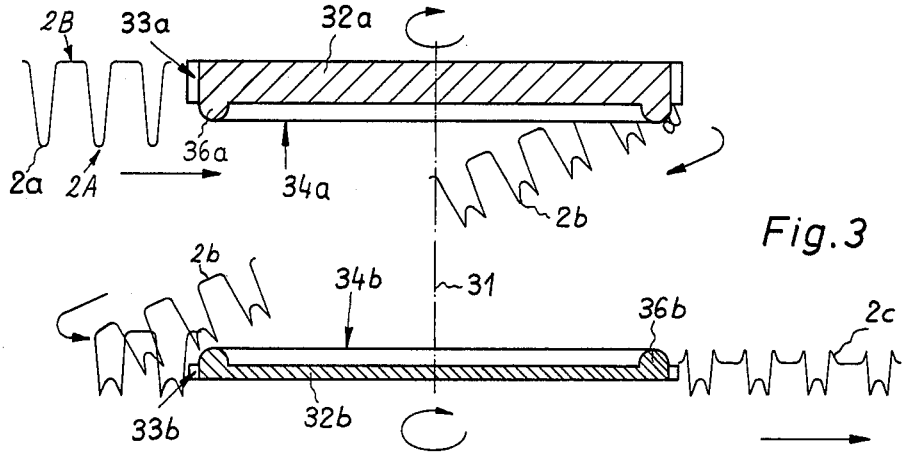
FIG. 3 is an axial sectional view of the anvils of the two deforming means in the apparatus of FIG. 1.
Figure 6:
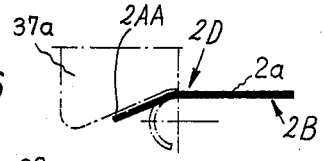
FIGS. 6 through 19 illustrate successive stages of conversion of a portion of undulate wire web into a portion of a C-shaped binder.
Figure 7:
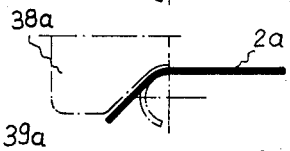
Figure 8:
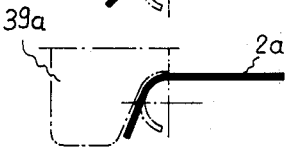
Figure 9:
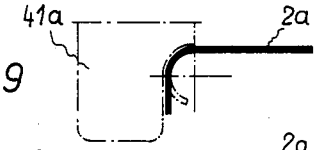
Figure 10:
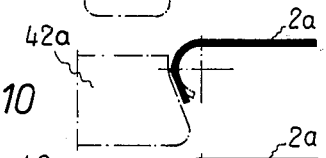
Figure 11:
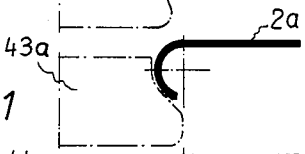

The apparatus of FIG. 1 further comprises a second or secondary deforming unit 3 which serves to covert the web 2*a* into a C-shaped or trough-shaped product 2*c* constituting a series of interconnected binders. This product (hereinafter called a continuous binder or simply binder for short) can be used to connect the sheets of a stack to each other, i.e., to convert such sheets into a steno pad, a calendar, a pamphlet, a brochure or the like. The conversion of the web 2*a* into the continuous binder 2*c* is carried out in such a way that the marginal portions 2A, 2B (FIG. 3) of the web are gradually bent toward each other so that the binder 2*c* exhibits a plurality of prongs at each of its edges. Such prongs can be inserted into the perforations of a stack of sheets prior to conversion of C-shaped portions of the binder into rings. The axis or axes about which the web 2*a* is bent to form the binder 2*c* extend lengthwise of the web.

The first or primary deforming unit 1 comprises two rotary carriers 6 and 7. The carrier 7 surrounds and is slightly eccentric with respect to the carrier 6. The front surface 6*a* and 7*a* of the carriers 6 and 7 are located in a common plane; such surfaces carry annuli of deforming pins and/or dogs (not specifically shown). Reference may be had to the commonly owned U.S. Pat. No. 4,165,767 granted to Seaborn and Lemberg on Aug. 28, 1979. The disclosure of this patent is incorporated, in its entirety, by reference in the disclosure of the present application. The rotary carriers 6, 7 are caused to rotate with each other due to the presence of torque transmitting or entraining pins which connect the carrier 7 to the carrier 6 (if the latter is driven) or vice versa. The drive means for the rotary carriers 6 and 7 comprises a shaft 8.

A looping arm 9 with two orbiting looping elements 9*a* is secured to a shaft 11. This looping arm is adjacent to the surfaces 6*a*, 7*a* in the region of minimal distance between the deforming elements on the carriers 6 and 7. A pivotable stripping finger 13 is mounted on a shaft 12 which is normal to the shafts 8 and 11. The shaft 12 is turnable by link 14 which is articulately connected to a strap 16 on an eccentric 18 secured to a shaft 17. When the shaft 17 rotates, the eccentric 18 and the strap 16 cause the link 14 to turn the shaft 12 back and forth.

The shaft 17 drives the shaft 11 via transmission 19 and receives torque from a toothed belt or chain drive 21. The latter receives motion from an intermediate shaft 22 which is driven by an electric motor 28 or another suitable prime mover by way of a second toothed belt or chain drive 27. The intermediate shaft 22 further transmits torque to the shaft 8 via chain or toothed belt drive 23, shaft 24 and transmission 26.

The second deforming unit 3 embodies the present invention and comprises two coaxial disc-shaped deforming anvils 32*a* and 32*b* (hereinafter called discs) which are mounted on a common shaft 31. The peripheral surfaces of the discs 32*a*, 32*b* are respectively formed with recesses or cutouts 33*a*, 33*b* (see FIGS. 3 and 4) for reception of successive increments or portions of the undulate web 2*a* leaving the first deforming unit 1. An intermediate stage of deformation of the web 2*a* (after it leaves the disc 32*a*) is shown at 2*b*.

Those sides (34*a*, 34*b*) of the discs 32*a*, 32*b* which face each other (see FIG. 3) are formed with annular projections 36*a*, 36*b* having a substantially semicircular cross-sectional outline. The annular projections 36*a*, 36*b* are inwardly and rather closely adjacent to the respective peripheral recesses 33*a*, 33*b*.

The peripheral surface of the disc 32*a* travels past a first set of four deforming tools in the form of rolls 37*a*, 38*a*, 39*a*, 41*a* and a second set of deforming tools or rolls 42*a*, 43*a*, 44*a*. Analogously, the peripheral surface of the disc 32*b* travels past a first set of four deforming tools or rolls 37*b*, 38*b*, 39*b*, 41*b* and a second set of deforming tools or rolls 42*b*, 43*b*, 44*b*. The axes of the shafts for the deforming rolls 37*a*, 37*b*, 38*a*, 38*b*, 39*a*, 39*b*, 41*a*, 41*b* are parallel or nearly parallel to the axis of the common shaft 31 for the discs 32*a*, 32*b*, and the axes of deforming rolls 42*a*, 42*b*, 43*a*, 43*b*, 44*a*, 44*b* are radial or substantially radial to the respective discs 32*a*, 32*b*. The construction, configuration and mounting of the deforming rolls 37*a* to 44*b* are such that each next-following deforming roll overlies the respctive annular projection 36*a* or 36*b* to a somewhat greater extent than the preceding deforming roll (see FIGS. 6–19). The term "overlies" is intended to denote as considered from the inner toward the outer side of the respective annular projection, i.e., from the inner edge toward the outer edge (2AA, 2BB) of the respective marginal portions (2A, 2B) of the web 2*a*.

Each of the discs 32*a*, 32*b* is associated with a rotary catcher 47*a*, 47*b* and a rotary stretching or tensioning wheel 46*a*, 46*b*. As shown in FIGS. 1, 2, 4 and 5, the tensioning wheels are disposed between the respective catchers and the associated discs. Also, the catchers 47*a*, 47*b* are located ahead of the corresponding discs 32*a*, 32*b*, as considered in the direction of lengthwise movement of the webs 2*a*, 2*b*.

The shaft 31 for the discs 32*a*, 32*b* receives torque from a toothed belt or chain drive 48 which, in turn, receives motion from a shaft 51 driven by a further toothed belt or chain drive 49. The latter receives motion from the shaft 24 (input shaft of the transmission 26) by way of a universal joint 53 (e.g., a Cardan shaft) and a transmission 52.

The tensioning wheels 46*a*, 46*b* and the rotary catchers 47*a*, 47*b* are respectively mounted on shafts 54*a*, 54*b* and 56*a*, 56*b*. The shafts 54*a*, 56*a* carry mating gears 57*a*, and the shafts 54*b*, 56*b* carry mating gears 57*b*. The shafts 54*a*, 54*b* receive torque from the common shaft 31 for the discs 32*a*, 32*b* via pairs of mating gears 58*a*, 58*b*. Additional toothed belt or chain drives 59*a*, 59*b* respectively connect the shafts 54*a*, 54*b* with shafts 61*a*, 61*b* for the deforming rolls 41*a*, 41*b*. Additional gears (not specifically shown) transmit torque from the shafts 61*a*, 61*b* to the shafts of the deforming rolls 39*a*, 38*a*, 37*a* and 39*b*, 38*b*, 37*b*. In addition, the shafts 61*a*, 61*b* drive shafts 63*a*, 63*b* via chain or toothed belt drives 62*a*, 62*b*. The shafts 63*a*, 63*b*, respectively, constitute the input elements of transmission 64*a*, 64*b* whose output elements 66*a*, 66*b* carry the deforming rolls 43*a*, 43*b*. The shafts 66*a*, 66*b* of the deforming rolls 43*a*, 43*b*, respectively, transmit torque to the deforming rolls 42*a*, 44*a* and 42*b*, 44*b* by way of suitable gear trains (not shown).

The construction of the catcher 47*a* and tensioning wheel 46*a* is respectively similar or identical to that of the catcher 47*b* and tensioning wheel 46*b*. Therefore, the drawing merely shows the details of the catcher 47*a* and tensioning wheel 46*a*, i.e., of those elements which are associated with the disc 32*a*. As best shown in FIG. 5, the catcher 47*a* comprises two spaced-apart circular parallel saw blade-like portions 71*a*', 71*a*" which are disposed at the respective ends of a cylindrical hub 72*a* forming part of the shaft 56*a*. The teeth 73*a*', 73*a*" of the portions 71*a*', 71*a*" have a spacing T1 (see FIG. 4) which exceeds the spacing T of the loops of the web 2*a*.

The tensioning wheel 46*a* comprises two spaced-apart parallel disc-shaped portions 74*a*', 74*a*" which are disposed at the respective axial ends of a hub 76*a* forming part of the shaft 54*a*. The portions 74*a*', 74*a*" are respectively formed with circumferential cutouts or tooth spaces 77*a*', 77*a*" for reception of portions of the web 2*a*. The spacing T2 between the centers of neighboring cutouts 77*a*' or 77*a*" is slightly less than the spacing T of the loops of the web 2*a*.

A stationary sheet metal shroud 78*a* prevents accidental or unintentional removal of the web 2*a* from the cutouts 77*a*', 77*a*". These cutouts are longer than the recesses 33*a* of the disc 32*a*. The spacing T between the centers of neighboring recesses 33*a* matches the spacing of the loops of the web 2*a*.

That side of the disc 32*a* which faces away from the annular projection 36*a* and the peripheral surface of the disc 32*a* are surrounded by a stationary cover 79*a* which has openings 81*a* in the region of the tensioning wheel 46*a*, in the region of the deforming rolls 36*a*–39*a*, 41*a*–44*a*, and in the region where the web 2*b* leaves the disc 32*a*. The cover 79*a* prevents escape of the web 2*a* from the recesses 33*a* and this cover also prevents axial shifting of the web 2*a* in the recesses 33*a* during deformation of the wire under the action of the rolls 37*a*–39*a* and 41*a*–44*a*. A similar cover is provided for the disc 32*b*.

Figure 4:
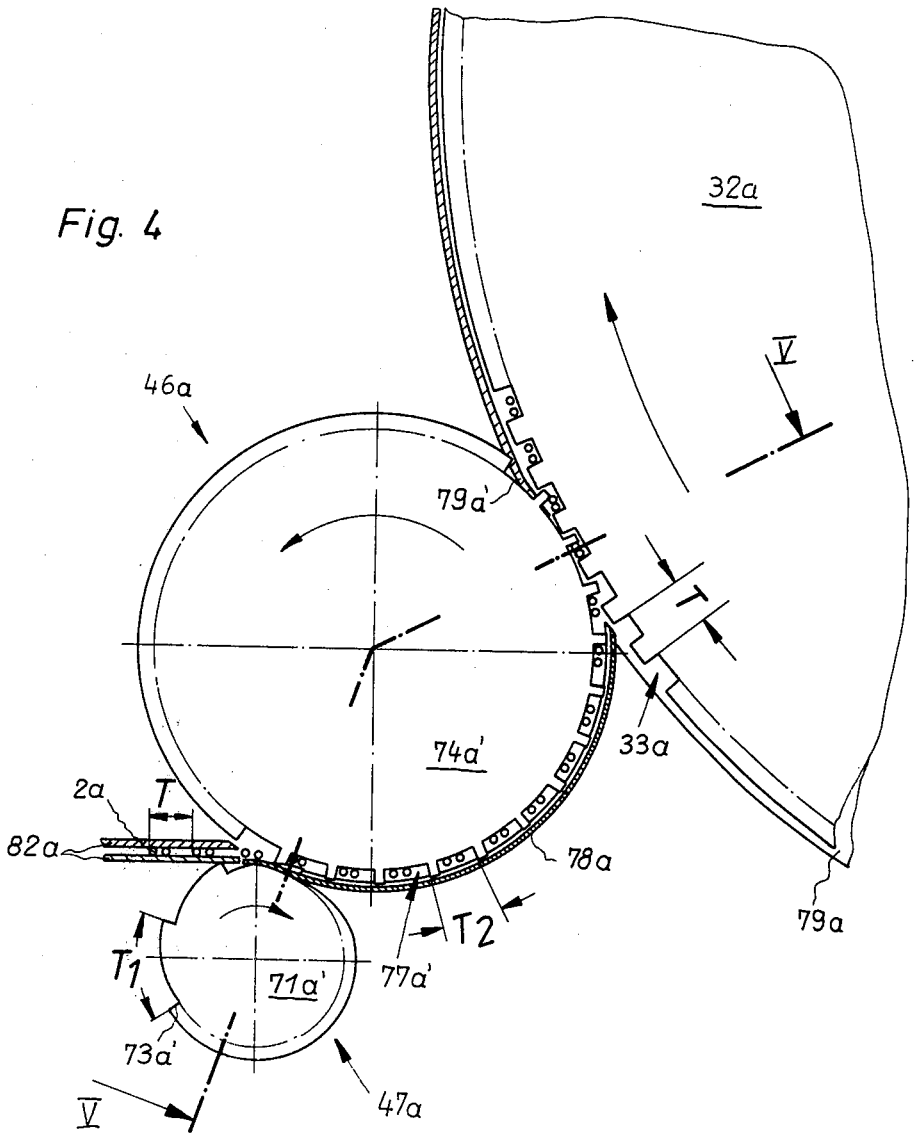
FIG. 4 is an enlarged fragmentary partly sectional view of a detail in the structure of FIG. 2.
Figure 5:
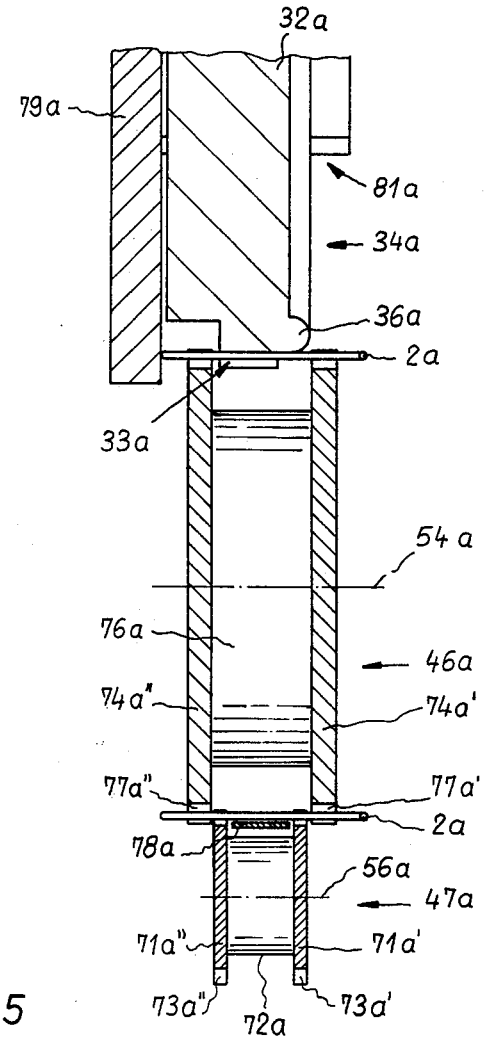
FIG. 5 is a sectional view as seen in the direction of arrows from the line V—V of FIG. 4.

The guide means for directing the web 2*a* toward the catcher 47*a* comprises two elongated strips 82*a* (see FIG. 4). The wire of the web 2*a* is pushed or pulled toward the catcher 47*a* while advancing in the channel between the strips 82*a*. Similar guide means (not shown) is provided to advance the web 2*b* from the disc 32*a* into the range of teeth on the catcher 47*b*. The manner of continuously driving the discs 32*a*, 32*b*, the catchers 47*a*, 47*b* and the tensioning wheels 46*a*, 46*b* is such that the quotients of the respective peripheral speeds and the spacings between the respective recesses, cutouts or teeth are identical.

The operation is as follows:

The elements 9*a* of the orbiting arm 9 drape the wire 2 around the pins of the inner carrier 6 which is driven by the shaft 8. The stripping finger 13 fully transfers the wire onto the pins of the member 6 and the wire is intercepted by the pins or dogs of the rotating outer carrier 7. Such wire is draped around the dogs under the action of the elements 9*a*. A stationary cam (not shown) removes the undulate web 2*a* from the pins and/or dogs of the carriers 6 and 7. The configuration of loops of the web 2*a* is fixed because the loops are stretched as a result of eccentrically of the carrier 6 relative to the carrier 7. Reference may be had to the aforementioned commonly owned U.S. Pat. No. 4,165,767.

The web 2*a* enters the channel between the strips 82*a* and advances toward the continuously rotating catcher 47*a* whose teeth 73*a*', 73*a*" enter the larger loops of the web to push successive pairs of closely adjacent transversely extending web portions into successive recesses 77*a*', 77*a*" of the continuously rotating tensioning wheel 46*a*. Since the spacing T2 between the centers of neighboring recesses 77*a*', 77*a*" is slightly less than the spacing T of neighboring loops of the web 2*a*, the web 2*a* on the tensioning wheel 46*a* is subjected to a tensional stress which insures that, in the region of transfer from the wheel 46*a* to the periphery of the disc 32*a*, the wire of the web 2*a* lies against the leading surfaces in the recesses 77*a*' and 77*a*". Such wire is guided by the edge portion 79*a*' of the cover 79*a*. This edge portion extends between the portions 74*a*' and 74*a*" of the tensioning wheel 46*a*, and its purpose is to guide successive increments of the web 2*a* into the peripheral cutouts 33*a* of the disc 32*a*. The rolls 37*a*, 38*a*, 39*a*, 41*a*, 42*a*, 43*a* and 44*a* bend or flex the loops at one outer edge 2AA of the web 2*a* in stepwise fashion (while the web 2*a* moves continuously). The deformation of the web 2*a* progresses from the center 2D toward the one outer edge 2AA of the respective marginal portion 2A in a manner as shown in FIGS. 6, 7, 8, 9, 10, 11, 12. Successive increments of the thus obtained web 2*a* are removed from the disc 32*a* and are advanced into the range of the catcher 47*a* whence the web 2*b* advances toward and onto the disc 32*b* via tensioning wheel 46*b*. The loops at the other marginal portion 2B of the web 2*b* are deformed by the rolls 37*b*, 38*b*, 39*b*, 41*b*, 42*b*, 43*b*, 44*b*, again starting at the center 2D of the web 2*b* and progressing toward the outer edge 2BB of the marginal portion 2B. The deforming action of the rolls 37*b*-39*b*, 41*b*- 44*b* is shown in FIGS. 13, 14, 15, 16, 17, 18 and 19. The thus obtained C-shaped or trough-shaped binder 2*c* is ready to be severed to yield sections of requisite length which are thereupon inserted into rows of perforations and deformed to form rings which connect the sheets of a stack along a selected edge of the stack. The subdivision into sections takes place subsequent to removal from the disc 32*b*. The details of the machine which connects the sections of binder 2*c* with stacks of sheets form no part of the invention. Reference may be had to U.S. Pat. No. 4,020,516 granted May 3, 1977 to Gomez or to U.S. Pat. No. 4,047,544 granted Sept. 13, 1977 to Seaborn et al.

Figure 12:
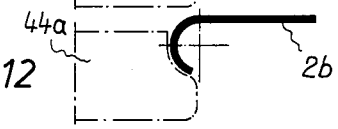
Figure 13:
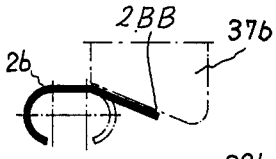
Figure 14:
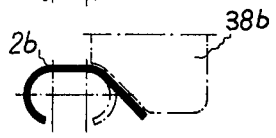
Figure 15:
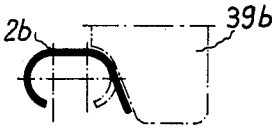
Figure 16:
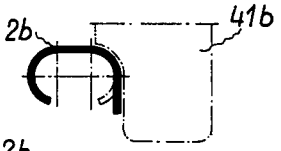
Figure 17:
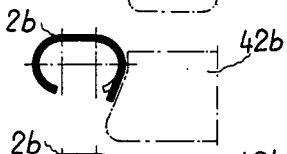
Figure 18:
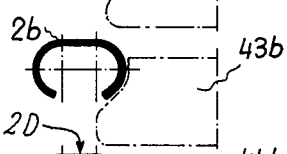
Figure 19:
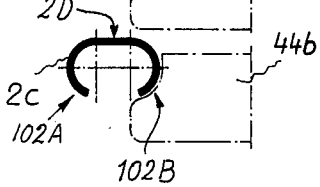

FIG. 12 shows that the fully converted marginal portion 2A of the web 2*a* has assumed to concavo-convex configuration 102A resembling one-half of the letter C, and FIG. 19 shows that the fully converted marginal portion 2B has assumed a concavo-convex configuration 102B which is a mirror image of the converted marginal portion 102A. The central portion 2D of the web 2*a* has remained flat so that the finished product 2*c* resembles an elongated capital letter C.

The manner in which the rolls 37*a*, 38*a*, 39*a*, 41*a*, 42*a*, 43*a*, 44*a* gradually deform the marginal portion 2A to convert this marginal portion into the arcuate portion 102A is shown in FIGS. 6 to 12. Such deformation is effected by bending the marginal portion 2A about the projection 36*a* at the one side 34*a* of the disc 32*a*. The deformation of successive increments of the web 2*a* begins close to the central portion 2D and progresses stepwise toward the outer edge 2AA of the marginal portion 2A. The manner in which the rolls 37*b*, 38*b*, 39*b*, 41*b*, 42*b*, 43*b*, 44*b* deform the marginal portion 2B by rolling it around the projection 36*b* of the disc 32*b* is shown in FIGS. 13 to 19 and is analogous to deformation of the marginal portion 2A.

It will be noted that, in accordance with the present invention, the web 2*a* and/or 2*b* can move continuously during gradual conversion of its marginal portions 2A, 2B into concavoconvex configurations 102A, 102B which are mirror images of each other (with respect to a plane extending midway of the central portion 2C and halving the final product 2*c*). In addition, the conversion of successive increments of the marginal portions 2A, 2B into the corresponding concavo-convex configurations 102A, 102B is effected gradually (stepwise) and in such a way that the deformation (by bending around the projections 36*a*, 36*b*) progresses from the inner edges toward the outer edges 2AA, 2BB of the respective marginal portions. Such sequence of steps renders it possible to directly couple the unit 1 with the unit 3, and to directly couple the unit 3 with a machine which inserts discrete Wire-O binders into the perforations of stacked paper sheets or the like. The output of the deforming unit 3 is surprisingly high, and the quality of the product 2*c* is quite satisfactory.

The mounting of discs 32*a*, 32*b* on a common drive shaft 31 contributes to compactness of the improved apparatus. The provision of means which drive the shafts of the deforming rolls 37 and 38 and derive motion from the shaft 31 or from a component receiving torque from the means for driving the shaft 31 also contributes to compactness and simplicity of the improved apparatus. The relatively narrow peripheral recesses of the discs 32*a*, 32*b* insure that the increments of the web 2*a* are properly held against uncontrolled stray movements during conversion of the marginal portions 2A, 2B into concavo-convex configurations 102A, 102B. During transfer of successive increments of the web 2*a* and 2*b* from the tensioning wheels 46*a*, 46*b* into the recesses 33*a*, 33*b* of the discs 32*a*, 32*b*, such increments are compelled to assume predetermined positions so that the apparatus can produce a series (2*c*) of interconnected C-shaped or trough-shaped binders with a high degree of reproducibility. This is due (at least in part) to the fact that each spacing or distance T2 is less than a distance or spacing T. As a rule, the increments of the web 2*a* or 2*b* which are transferred onto the wheels 32*a*, 32*b* are caused to lie against the leading edges of teeth between the recesses 33*a*, 33*b*. The increments also lie against the teeth of the catchers 47*a*, 47*b*. This insures predictable transfer or successive increments or hairpin-shaped loops of the web 2*a* and 2*b* onto the discs 32*a* or 32*b*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of converting a web of undulate wire which includes two longitudinally extending marginal portions into a series of interconnected substantially C-shaped binders, comprising the steps of moving the web lengthwise: gradually imparting to successive increments of one marginal portion of the web a concavo-convex configuration which, in cross-section, resembles substantially one-half of the letter C; and thereafter gradually imparting to successive increments of the other marginal portion a concavo-convex configuration which is substantially a mirror image of concavo-convex configuration of the one marginal portion.

2. The method of claim 1, wherein said moving step comprises continuously conveying the web along a predetermined path.

3. The method of claim 1, wherein one of said imparting steps follows the other of said imparting steps.

4. The method of claim 1, wherein each of said marginal portions includes an outer edge and each of said imparting steps comprises deforming the web in a direction toward the outer edge of the respective marginal portion.

5. The method of claim 4, wherein each of said imparting steps includes deforming successive increments the respective marginal portion in a plurality of discrete stages.

6. The method of claim 1, wherein at least one of said imparting steps includes deforming successive increments of the respective marginal portion in stepwise fashion.

7. The method of claim 1, further comprising the step of tensioning successive increments of the web in the longitudinal direction of the wire prior to at least one of said imparting steps.

8. The method of claim 1, wherein the web further includes a longitudinally extending substantially flat central portion intermediate the two marginal portions and further comprising the step of leaving the central portion flat in the course of said imparting steps.

9. Apparatus for converting a web of undulate wire which includes two longitudinally extending marginal portions into a series of interconnected substantially C-shaped binders, comprising means for moving the web lengthwise; means for gradually imparting to successive increments of one marginal portion of the web a concavo-convex configuration which, in cross-section resembles substantially one-half of the letter C; and subsequent means for gradually imparting to successive increments of the other marginal portion of the web a concavo-convex configuration which is substantially a mirror image of the concavo-convex configuration of the one marginal portion.

10. The apparatus of claim 9, wherein said moving means includes means for continuously conveying the web in a predetermined direction and along a predetermined path, said imparting means comprising rotary components adjacent to discrete portions of said path and having peripheral surfaces provided with recesses for the increments of the continuously moving web.

11. The apparatus of claim 10, further comprising means for rotating said components about a common axis.

12. The apparatus of claim 10, wherein each of said rotary components has a side provided with an annular projection of substantially semicircular cross-sectional outline and each of said imparting means further comprises a plurality of rotary deforming tools adjacent to the respective component and arranged to bend successive increments of the moving web around the respective annular projection.

13. The apparatus of claim 12, further comprising means for continuously rotating said components, said projections being closely adjacent to the peripheral surfaces of the respective components.

14. The apparatus of claim 13, wherein said deforming tools are driven rolls having peripheral surfaces adjacent to the projections of the respective components.

15. The apparatus of claim 14, wherein each marginal portion of the web includes an outer edge and said driven rolls are positioned to bend successive increments of the corresponding marginal portion of the web stepwise in a direction toward the outer edge of such marginal portion.

16. The apparatus of claim 14, wherein said means for rotating said components includes means for rotating said rolls.

17. The apparatus of claim 10, wherein said conveying means comprises rotary catchers each located ahead of the respective component, as considered in said direction, and a rotary wire stretching wheel disposed intermediate each catcher and the corresponding component.

18. The apparatus of claim 17, wherein each of said catchers has peripheral wire-engaging and entraining teeth.

19. The apparatus of claim 17, wherein said wheels have peripheral tooth spaces for the increments of the web and the width of said tooth spaces exceeds the width of said recesses.

20. The apparatus of claim 17, wherein the web comprises a plurality of transversely extending loops and the distance between the neighboring loops is less than the distance between the centers of neighboring tooth spaces on said stretching wheels.

* * * * *